United States Patent [19]

Indig

[11] Patent Number: 4,828,490

[45] Date of Patent: May 9, 1989

[54] FURNACE FOR DENTAL WORKPIECES

[76] Inventor: Baruch Indig, 16 Tshernichovsky Street, Tel-Aviv, Israel

[21] Appl. No.: 59,780

[22] Filed: Jun. 8, 1987

[30] Foreign Application Priority Data

Jun. 12, 1986 [IL] Israel ..... 79109

[51] Int. Cl.[4] ..... F27D 5/00

[52] U.S. Cl. ..... 432/124; 432/241; 432/253

[58] Field of Search ..... 432/239, 241, 124, 253, 432/6.5, 152; 414/160, 180, 214, 198

[56] References Cited

U.S. PATENT DOCUMENTS

| | | | |
|---|---|---|---|
| 1,838,015 | 12/1931 | Von Forster et al. | 432/241 |
| 2,344,035 | 3/1944 | Etten | 432/124 |
| 2,454,253 | 11/1948 | Kniseton | 432/6 |
| 2,940,745 | 6/1960 | Goiegel et al. | 432/253 |
| 3,463,470 | 8/1969 | Green et al. | 432/241 |
| 3,836,325 | 9/1974 | Nokamura et al. | 432/241 |
| 3,867,093 | 2/1975 | Huttermann | 432/241 |
| 4,610,628 | 9/1986 | Mizushina | 432/241 |

*Primary Examiner*—Henry C. Yuen

*Attorney, Agent, or Firm*—Oblon, Fisher, Spivak, McClelland & Maier

[57] ABSTRACT

The invention relates to an improved furnace oven for drying and firing porcelain dental workpieces. It has a plurality of worktables which can be inserted at a desired sequence into the muffle of the furnace oven. The workpiece to be processed is placed on, or prepared on one of the supports, the arm of such support is swung into a position beneath the opening of the muffle and lifted into the muffle. The furnace is of the vacuum type, and can be preprogrammed. It is possible to provide furnaces of this type where a number of programs can be prepared according to the number of supports and thus time is saved between the end of one firing cycle and the start of the next one with a new workpiece.

4 Claims, 4 Drawing Sheets

FURNACE FOR DENTAL WORKPIECES

FIELD OF THE INVENTION

The invention relates to improvements in vacuum furnaces used for the production of dental porcelain products from single crowns to arch restorations. The modified furnaces permit an increase of production rate by providing more than one support for the preparation of the product which is to be glazed.

BACKGROUND OF THE INVENTION

After preparing a gypsum mould of the damaged tooth, which is to be completed, the technician produces a metal cap which covers the residue of the damaged tooth. On this cap there is positioned a viscous mixture comprising porcelain powder and a predetermined shape is formed, adapted to replace the tooth. The product is then placed on the movable support of the furnace and this is gradually introduced into the interior of the vacuum furnace for drying and firing.

The interior temperature is increased in a predetermined manner, up to the required temperature which is generally of the order of about 1000° C., while a reduced pressure is established, and the mixture is thus converted to the desired glazed porcelain, converting the granular mixture to a homogeneous mass. The heating conditions have to be adjusted according to the nature of the starting materials, and up-to-date furnaces are preprogrammed to carry out such heating and cooling sequences in an essentially automatic manner. The furnaces are equipped with a micro-processor, and this is provided with suitable software for the required process steps.

It is one of the drawbacks of existing furnaces that there exists only one program for the drying and firing cycle of the dental workpiece. Thus, when such item is ready, it is removed from the furnace, the next item is positioned on the support, if required, a new program is established and the workpiece is subjected to its drying and firing cycle.

Such use of the rather expensive equipment is not economical and only one technician can use the furnace at a given time.

The novel furnace of the invention provides more than one support for the dental workpieces, and also a number of program settings according to the number of supports. Thus, while one workpiece is being fired, the next one or next ones can be prepared, the corresponding drying and firing programs can be set and when the first item is finished, it is possible immediately to continue with the drying and firing of the next item.

It ought to be pointed out that the drying and firing cycle comprises a plurality of steps and parameters, such as temperature increase rate, duration of firing, vacuum at each stage, rate of decrease of temperature, etc. Actually, some firing cycles comprise up to about 10 various parameters which have to be pre-programmed.

Thus it is possible to use a furnace in a manner that one item after the other is dried and fired, using the multiple supports and programs to attain a much better economics of the entire work process.

SUMMARY OF THE INVENTION

According to the invention there are provided vacuum furnaces for the production of dental procelain products (crowns, etc.), which are characterized by the provision of more than one support for items to be heat-treated and glazed in the furnace, each of these being used after the other according to a certain predetermined program.

There can be optionally provided furnaces with the auxiliary equipment for visual inspection during the heating process, with digital parameter display etc, which furnaces are equipped with more than one working table (support means), and with means for introducing each of these, one after the other, into the heating chamber proper of the furnace. The novel furnace makes it possible to prepare a new item to be heat-treated while the first one is still in the heating chamber, and when the first item is withdrawn, and cooled down, the second support member is utilized for the introduction of the next item into the furnace chamber, the preparation and waiting time being utilized in a much more efficient manner.

The invention is illustrated with reference to the enclosed schematical drawings, not according to scale, in which.

Figure 1:
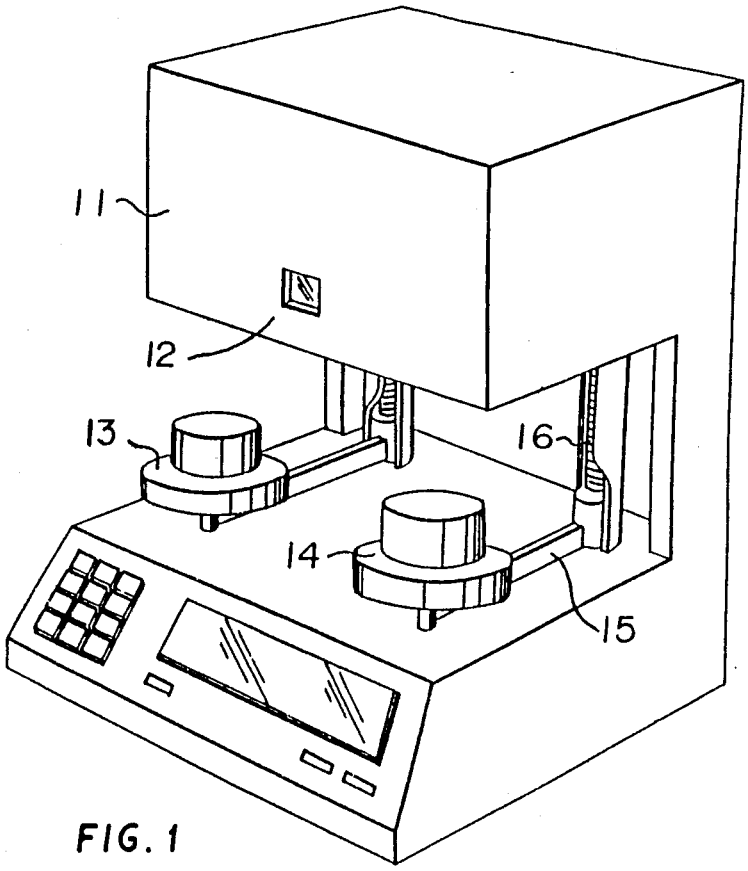
FIG. 1 is a perspective view of a furnace according to the invention provided with two work-piece supports.

As illustrated in FIG. 1, the vacuum furnace comprises a housing 11, with a furnace section in the upper part 12, there being provided two supports 13 and 14 for dental products (crowns or the like), both of which are shown in a stand-by position.

Figure 3:
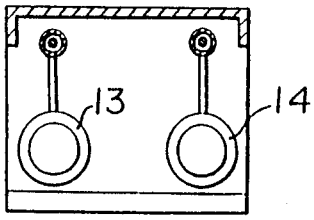
FIG. 3 is a top view of the support member mechanism of the furnace of FIG. 1.
Figure 2:
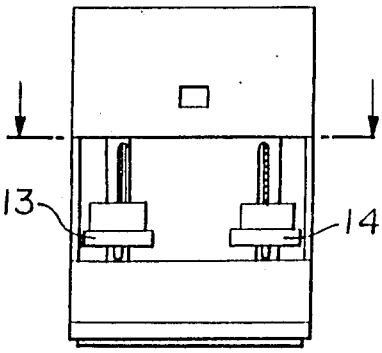
FIG. 2 is a front view of the furnace of FIG. 1.
Figure 4:
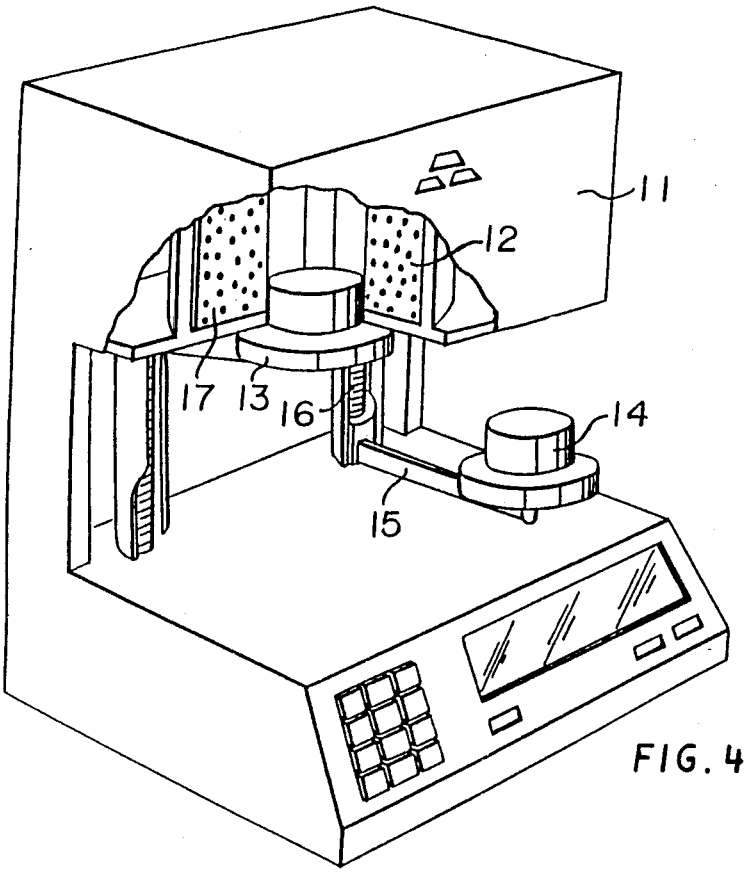
FIG. 4 illustrates in partial section certain details of the construction of the furnace of FIG. 1.
Figure 5:
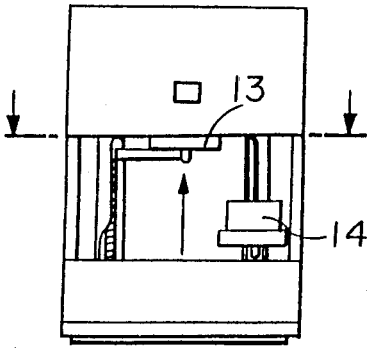
FIG. 5 illustrates the position when the left-hand support is in its upper position with the workpiece in the furnace chamber.
Figure 6:
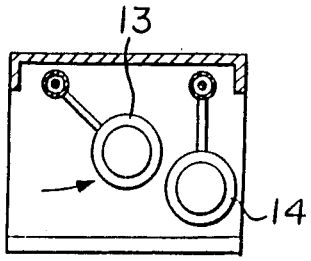
FIG. 6 is a top view indicating the relative position of the two supports while the left-hand one is used for heating.
Figure 7:
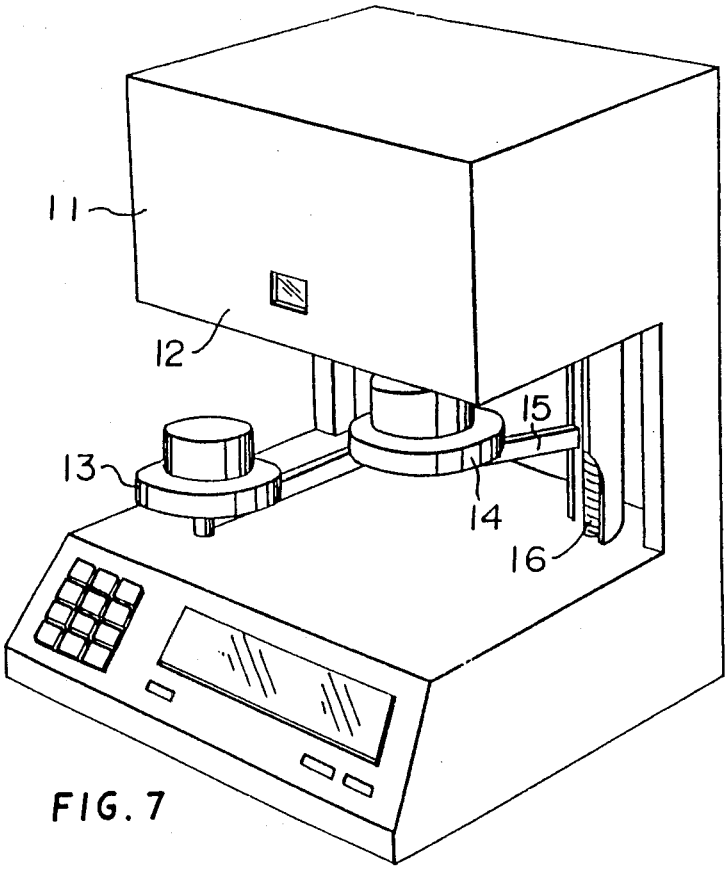
FIG. 7 is another perspective view of the furnace with two supports, with the right-hand support in working position.
Figure 8:
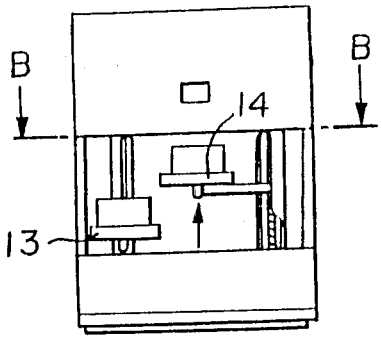
FIG. 8 is a front view of the device of FIG. 7.
Figure 9:
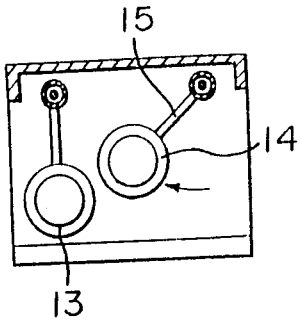
FIG. 9 is a view taken along B-B' of FIG. 8, indicating the relative positions of the two supports.

FIGS. 2 and 3 illustrate the furnace according to FIG. 1. As indicated, the support 14 is attached by horizontal member 15 to the lifting mechanism 16, which allows a swinging of the support to the center of the device. Details are illustrated with reference to FIG. 4, where the left-hand support 13 is shown inside the heating chamber 17, while the other support 14 being in a stand-by position. Details of the relative positions of these are indicated in FIGS. 5 and 6. Details of the same device, with the support 14 in operating position, and support 13 in stand-by position, ready for the preparation of the next dental product, are shown in FIGS. 7, 8 and 9.

Figure 10:
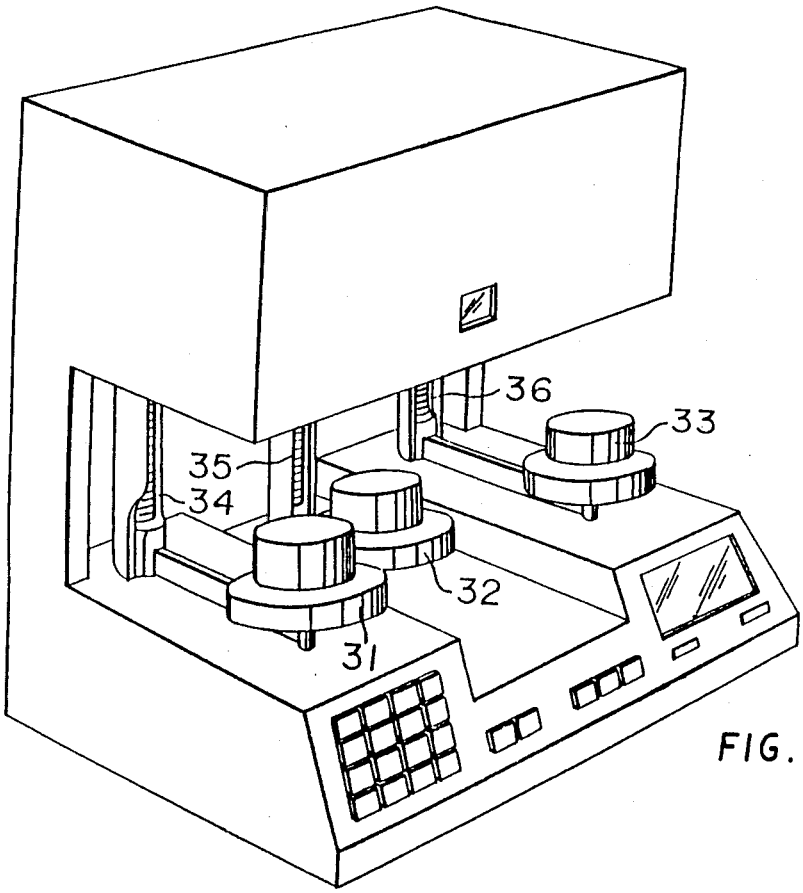
FIG.10 is a perspective view of a device with three work-support tables.
Figure 12:
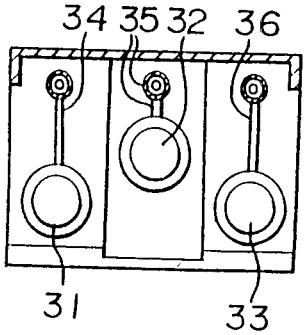
FIG.12 is a view along line C-C' of FIG. 11.
Figure 11:
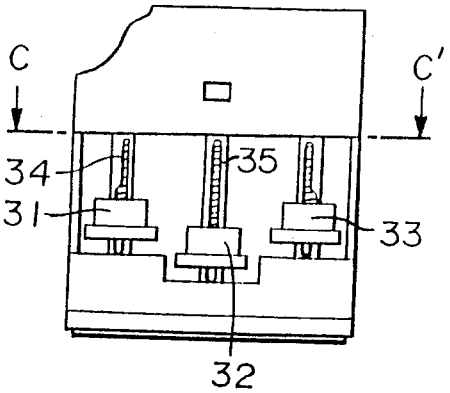
FIG.11 is a front view of the device of FIG. 10.

Another embodiment of the invention, with three supports, 31, 32 and 33, is shown in FIGS. 10, 11 and 12. Details of the lifting mechanisms 34, 35 and 36 are shown in FIG. 11, while FIG. 12 illustrates the arms of the supports which serve to position the supports exactly beneath the opening of the furnace before the workpiece is lifted up for the heat treatment (glazing) of the mixture resulting in the finished porcelain product.

It is clear that the furnaces are equipped with the up-to-date features of modern vacuum furnaces, including calibration and purging programs, automatic temperature control, automatic control of the heating rate, means for visual inspection of the product during the firing process control of the vacuum. The furnace can be provided with pre-set programs according to the starting materials and desired products.

It is a further advantage of the novel furnace that the support of the workpiece which is not in the interior of the muffle is positioned close to the front, at one of the sides, not beneath the muffle, and this position facilitates the preparation of the next workpieces.

At the end cycle the support slides down, is moved sidewards and thus the workpiece is no more beneath the opening of the muffle and can be removed without problems.

The above description is by way of illustration only and it is clear that various changes and modifications of the nature and arrangements of components can be resorted to without departing from the scope and spirit of the invention.

I claim:

1. A furnace for firing dental replacements such as crowns, bridges and the like, comprising:

a muffle having a bottom opening, said muffle defining a heating chamber comprising means for enclosing a single workpiece to be fired;

at least two support means for workpieces to be fired in the muffle, each of said support means being located on an arm extending from a vertical support, said arms having means for swinging motion in an essentially horizontal direction, so that at any period of time the arm of one of said support means will be beneath the opening of the muffle, and means for alternately moveing said one of said support means upwards into said muffle;

whereby after firing said one of said support means may be moved in a downward direction and swung horizontally out from beneath said opening of the muffle and the another of said support means may be moved beneath the opening of the muffle.

2. A furnace of the type claimed in claim 1, of the vacuum type.

3. A furnace according to claim 1, provided with two of said support means.

4. A furnace according to claim 1, provided with three of said support means.

* * * * *